US006168541B1

(12) United States Patent
Gibbs

(10) Patent No.: US 6,168,541 B1
(45) Date of Patent: Jan. 2, 2001

(54) ILLUMINATED PING PONG

(76) Inventor: Kirk Gibbs, 312 Chase Common Dr., Norcross, GA (US) 30071

( * ) Notice: Under 35 U.S.C. 154(b), the term of this patent shall be extended for 0 days.

(21) Appl. No.: 08/866,579

(22) Filed: May 30, 1997

(51) Int. Cl.[7] ..... A63B 67/04; A63B 71/04; F21V 33/00

(52) U.S. Cl. ..... 473/497; 473/475; 362/253

(58) Field of Search ..... 473/475, 496, 473/DIG. 24; 362/253

(56) References Cited

U.S. PATENT DOCUMENTS

| | | | | |
|---|---|---|---|---|
| 3,971,560 | * | 7/1976 | Panosh | 273/30 |
| 4,227,508 | | 10/1980 | D'Andrade | 124/16 |
| 4,241,716 | | 12/1980 | Tsui | 124/27 |
| 4,943,056 | | 7/1990 | Bowers | 273/30 |
| 5,301,955 | * | 4/1994 | Fedullo | 273/411 |
| 5,305,998 | * | 4/1994 | Nesbit et al. | 273/1.5 R |
| 5,417,438 | * | 5/1995 | Poff | 273/411 |
| 5,487,541 | | 1/1996 | Dictor | 273/30 |
| 5,733,210 | * | 3/1998 | Yu | 473/475 |

* cited by examiner

*Primary Examiner*—Robert A. Hafer
*Assistant Examiner*—Laura Fossum

(57) ABSTRACT

An illuminated ping pong game comprises a table which comprises at least one table leg. The illuminated ping pong game further comprises a net securely fastened to a the table along a median thereof. The illuminated ping pong game further comprises at least two player's paddles utilized by at least one first player and second player. At least one player's paddle comprises a first player's paddle which comprises a first player's paddle handle having a first player's paddle handle ON/OFF cap positioned at a bottom distal end of a first player's paddle handle cylinder forming a first player's paddle handle cavity therein. The first player's paddle handle further comprises a first player's paddle handle illuminator integrally associated therewith. The first player's paddle handle illuminator comprises a first player's paddle handle illuminator light positioned at a top distal end within the first player's paddle handle cavity. The first player's paddle handle illuminator further comprises a first player's paddle handle power means electrically connected to the first player's paddle handle illuminator light and the first player's paddle handle ON/OFF cap. When an user rotates the first player's paddle handle ON/OFF cap, the first player's paddle handle illuminator light is activated by the first player's paddle handle power means illuminating a first player's paddle head which is securely attached to the first player's paddle handle. An optional illuminated net is also described and claimed.

12 Claims, 4 Drawing Sheets

ILLUMINATED PING PONG

FIELD OF THE INVENTION

The present invention relates toping pong. More particularly, the present invention relates to an illuminated enhancement to the game equipment.

BACKGROUND OF THE INVENTION

Ping Pong is a game which has been in existence for many years and is basically played unchanged. The attempts in the past to modify the game have resulted in little improvement or change to the basic method of play. What is desired is an enhancement which challenges the skills of the players yet does not require new basic skill to be developed so that the experienced player is continued to be challenged.

Numerous innovations for Illuminated Ping Pong have been provided in the prior art that are described as follows. Even though these innovations may be suitable for the specific individual purposes to which they address, they differ from the present invention as hereinafter contrasted.

In U.S. Pat. No. 5,487,541, issued on Jan. 30, 1996, titled Ping Pong Table Cover, invented by Ivan S. Dictor, and filed on Jun. 20, 1994, there is disclosed a cover for a regulation sized ping pong table in which a helical turns about a centrally support shaft the two ends of the cover are played out in opposite directions for attachment to cooperating opposite ends of the table to protect the playing area beneath the cover from weather elements, and wherein the length of the cover is of similar ping pong table regulation size so that it is in a taut condition, i.e. devoid of excess size to better promote gravity flow of rain therefrom as well as to provide resistance to wind gusts, and to have other utilitarian features.

In U.S. Pat. No. 4,943,056, issued on Jul. 24, 1990 titled Ping Pong Table Accessory Apparatus, invented by Kenin R. Bowers, filed on Feb. 27, 1989, a ping pong accessory for use with a ping pong table; wherein, the apparatus includes a rotatable ball rebound backboard unit and a plurality of pivoting sideboard units suspended from a movable support unit; whereby, the backboard unit and sideboard units maybe disposed at selected angles and orientations relative to one another and to the ping pong table.

In U.S. Pat. No. 4,241,716, issued on Dec. 30, 1980, titled Automatic Toy Gun for Ping Pong Balls, invented by Kwok W. Tsui, filed on Feb. 12, 1979, there is taught a toy gun simulating an automatic rifle adapted to shoot ping pong balls and comprising a pair of complementary molded hollow shells which are connectable along a central plane to form an elongated frame having a shoulder stock at the rear end, a short cylinder barrel at the forward end, a stationary support handle extending downward from said frame intermediately of the ends thereof a magazine extending upward and rearward from said barrel to hold a limited number of ping pong balls for discharge into said barrel, a firing ram supported by a guide device for reciprocation within the interior of the frame and having a ball-engaging member on the forward end and a head on the rearward end provided with a slot perpendicular to the path of the movement of the ram, a crank rotatably supported by one side of the frame and connected to a support rotatable therewith. The support has a crank pin positioned for movement in said slot, and a compression spring within the frame operable upon the firing ram to project the same forwardly to fire a ball from said barrel incident to the crank pin moving from the upper end of said slot in the head of the firing pin ram prior to the pin reaching its zenith of movement.

In U.S. Pat. No. 4,227,508, issued Oct. 14, 1980, titled Toy Automatic Pistol for Ping Pong Balls, invented by Bruce M. D'Andrade, filed Dec. 22, 1978, a toy pistol is disclosed for shooting ping pong balls. The pistol includes a frame with a barrel portion at the forward end and a handle extending downward from the rearward end, a magazine extending upward and rearward therefrom, a ram moveable along longitudinal guide member in the frame rearward from said barrel portion, a compression spring to fire the ram forward, and a T-shaped combination trigger and sear having a head with a sear movable generally parallel to and below said guide members, the stem of said T-shaped member being movable into the forward portion of said handle and said head having pins on the opposite end movable in forward and rearward guide slots in the frame, the rearward slot exiting rearward and downward, whereby near the end of rearward movement of said T-shaped member the rear end of said head is moved downward to disengage the sear on said head from said ram which is fired forwardly by said compression spring and a tension spring automatically restores the T-shaped member forwardly to starting position.

The above patented inventions differ from the present invention because they fail to describe or claim at least one combination of the following features depicted in the present invention; a lighted paddle in combination with a lighted net flourescent painted ball and flourescent court lines.

SUMMARY OF THE INVENTION

The present invention is an unique enhancement to the game of ping pong. Lighted paddles and a lighted net are provided. Further a ping pong ball and court lines are flourescent materials.

The types of problems encountered in the prior art are limited enhancements to the game of ping pong.

In the prior art, unsuccessful attempts to solve this problem were attempted namely: enhancements to the game consist of a cover provided to protect the table from the weather and a training device is provided to rebound and return the ball to the server when one player is practicing. However, the problem was solved by the present invention because an enhancement is provided for the players.

The present invention solved a long felt need for an improvement to the game of ping pong.

Accordingly, it is an object of the present invention to provide illuminated of the game equipment.

More particularly, it is an object of the present invention to provide illuminated paddles and net.

In keeping with these objects, and with others which will become apparent hereinafter, one feature of the present invention resides, briefly stated, in paddles having a source of illumination.

When the Illuminated Ping Pong is designed in accordance with the present invention, lighted paddles and nets are combined with further flourescent ping pong balls and court lines to enhance the game.

In accordance with another feature of the present invention, paddles have a power source contained within the handle controlled by an ON/OFF cap.

Another feature of the present invention is that the illumination means of the handle is a plurality of illuminator lights in the handle directed toward the paddle head so that the light falls on to the paddle head.

Yet another feature of the present invention is that the net is supported on both ends.

Still another feature of the present invention is that the net supports contain illuminators which direct light from an illumination source such as a light bulb on to the net.

Yet still another feature of the present invention is that the net supports have an ON/OFF switch to control the lights.

Still yet another feature of the present invention is that the paddle head is manufacture from a light conductive material.

The novel features which are considered characteristic for the invention are set forth in the appended claims. The invention itself, however, both as to its construction and its method of operation, together with additional objects and advantages thereof, will be best understood from the following description of the specific embodiments when read and understood in connection with the accompanying drawings.

BRIEF DESCRIPTION OF THE DRAWING

FIG. 3 is a front view of a net taken along line 4—4 of FIG. 1.

DESCRIPTION OF THE PREFERRED EMBODIMENT

Figure 1:
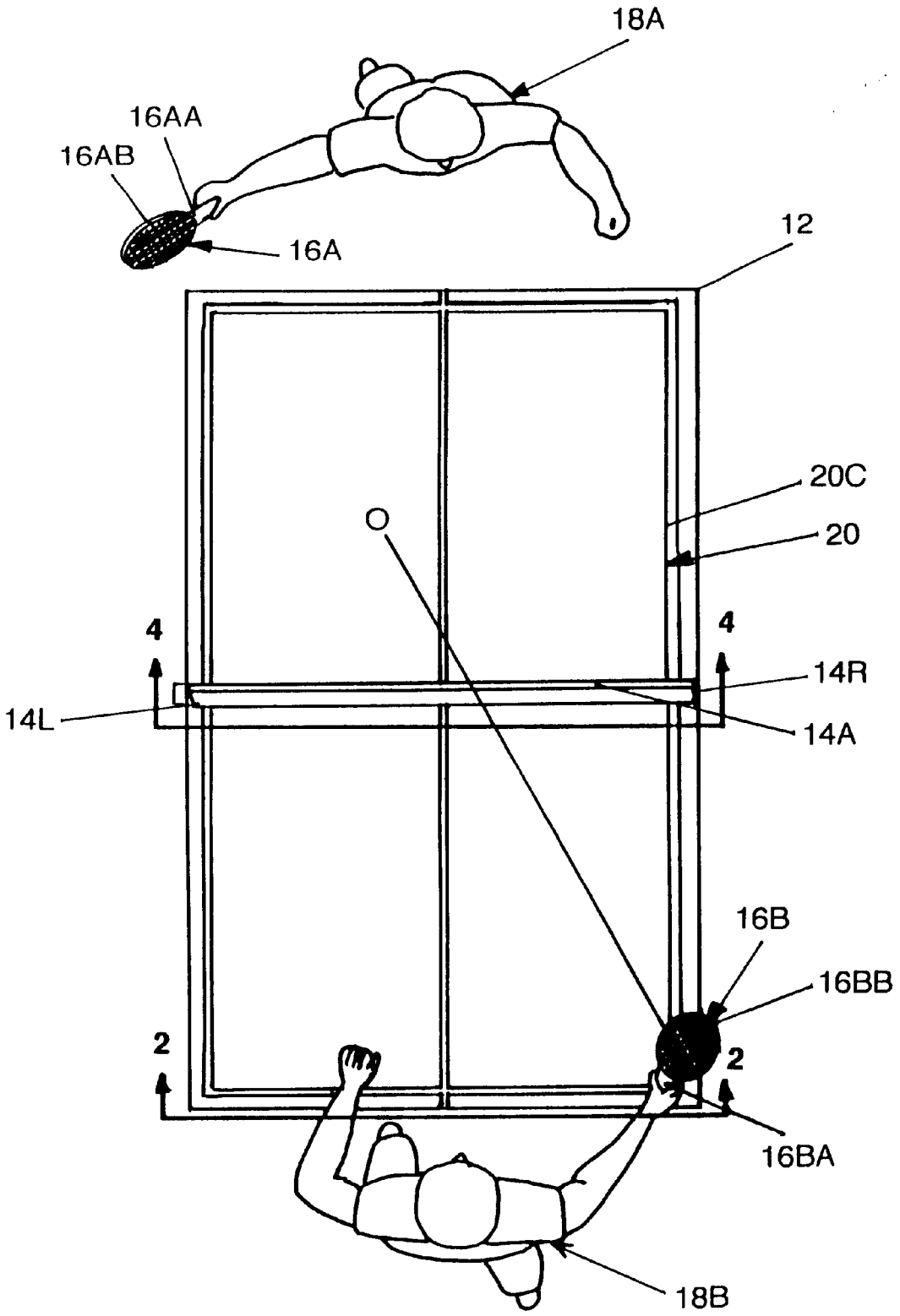
FIG. 1 is a top view of an illuminated ping pong game exhibiting a first player using a first player's paddle and a second player and a second player's paddle in accordance with the present invention.
Figure 2:
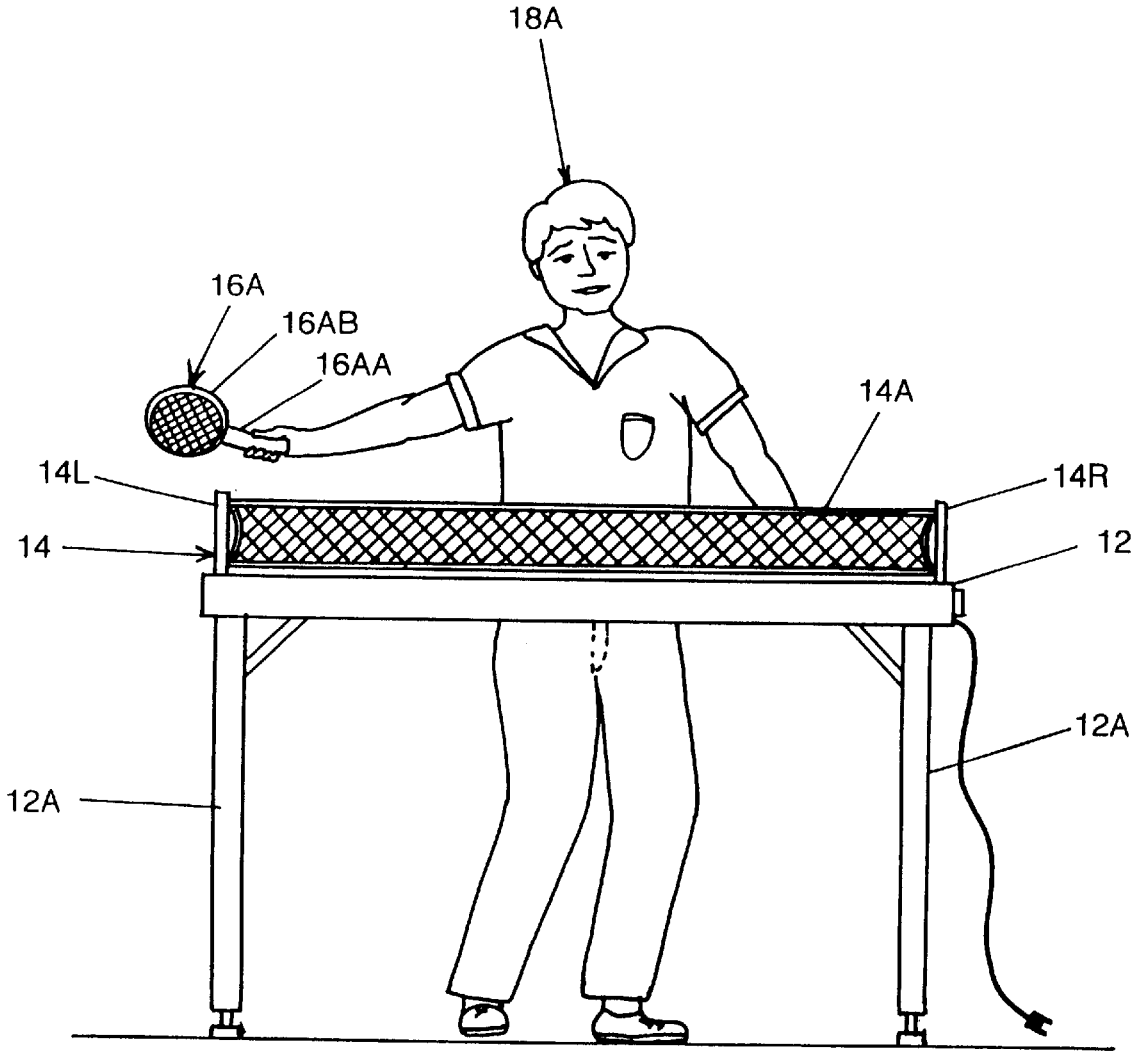
FIG. 2 is a side view of the illuminated ping pong game taken along line 2—2 of FIG. 1.
Figure 2A:
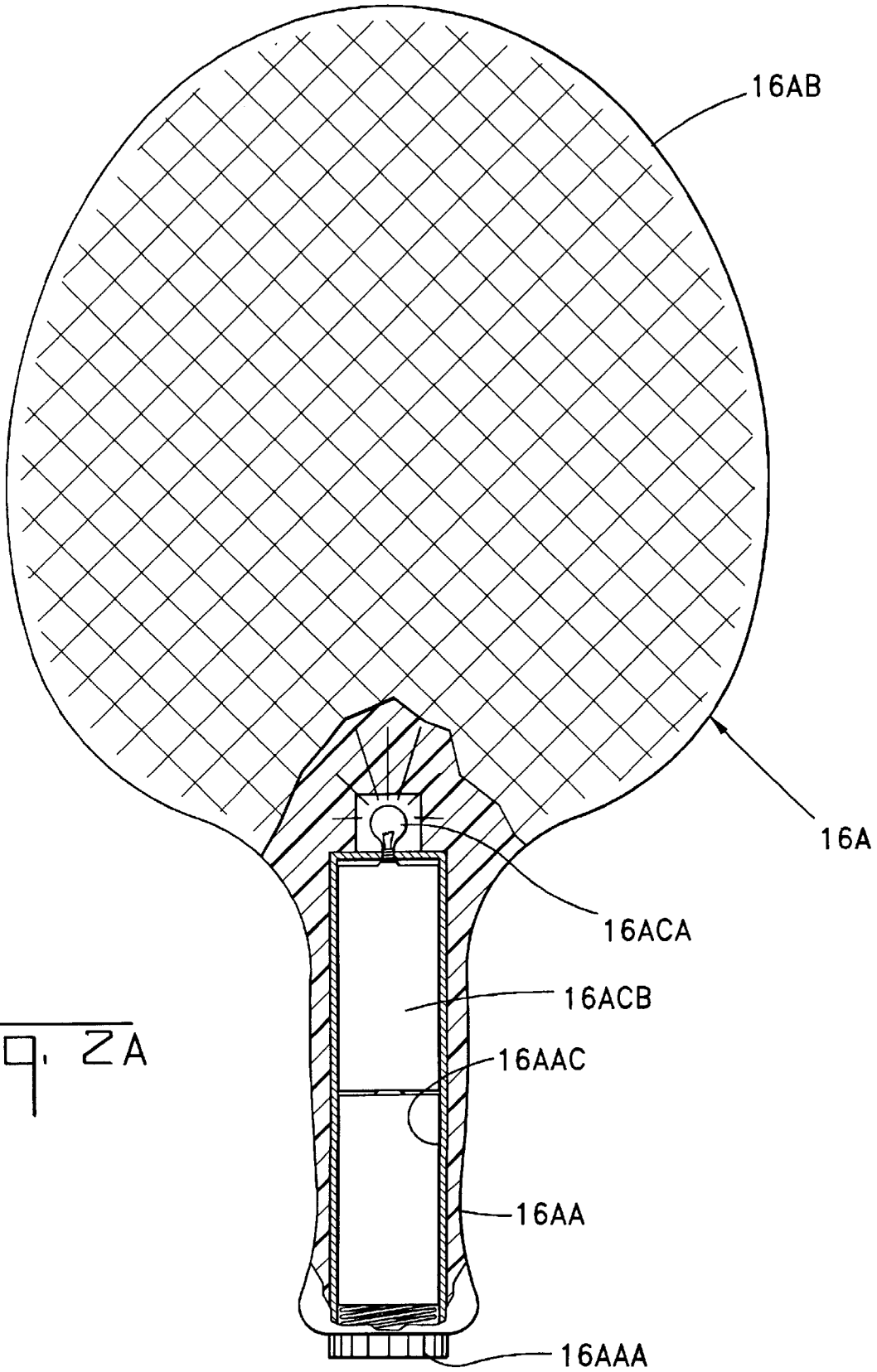
FIG. 2A is a front view of a ping pong paddle in accordance with this invention, where portions of the paddle have been removed to reveal certain internal details.
Figure 7:
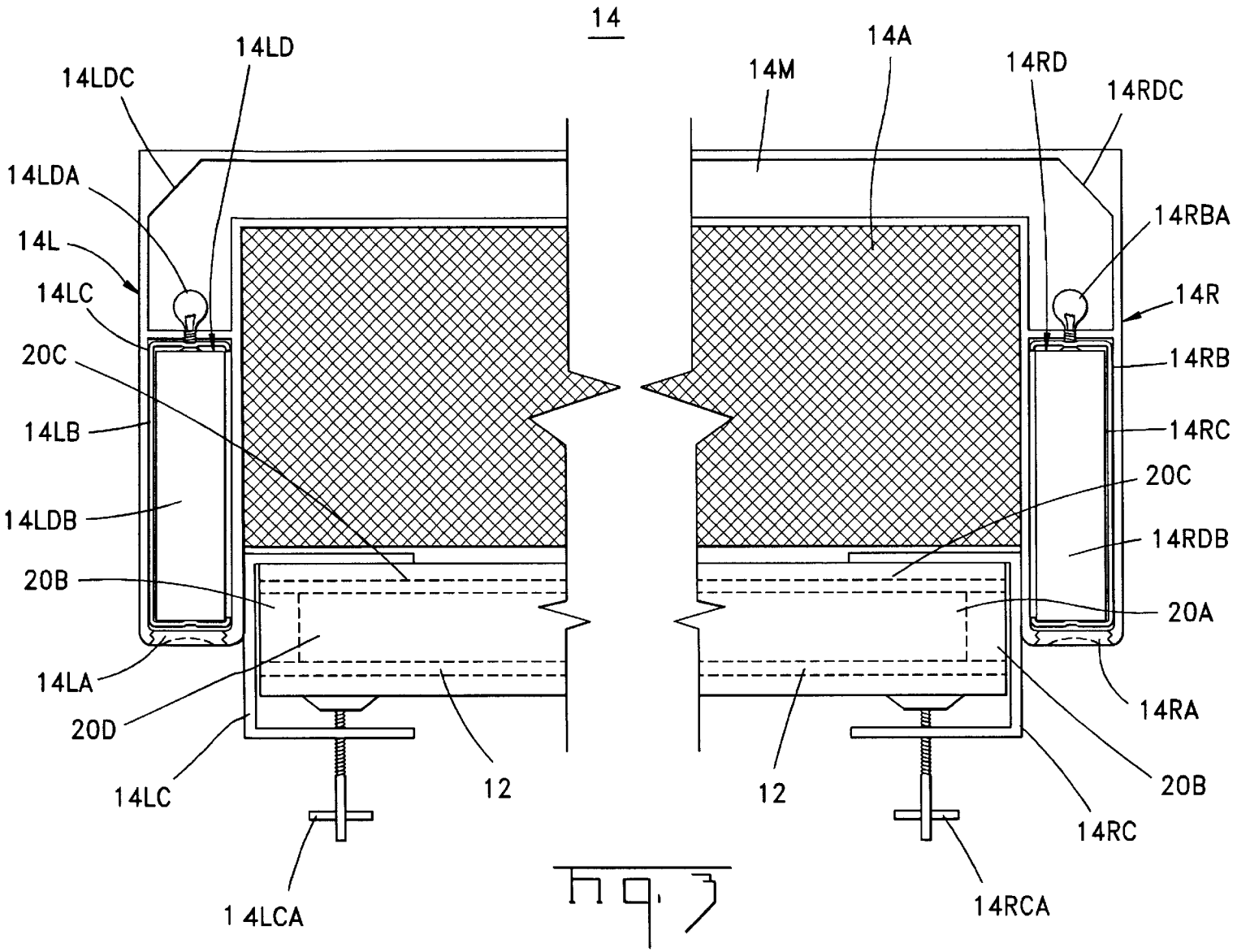

Firstly, referring to FIG. 1 which is a top view of an illuminated ping pong game (10) exhibiting a first player (18A) using a first player's paddle (16A) and a second player (18B) and a second player's paddle (16B). Referring to FIG. 2 which is a side view of an illuminated ping pong game (10) along line 2—2 of FIG. 1 exhibiting a first player (18A) using a first player's paddle (16A) see FIG. 2A. The illuminated ping pong game (10) comprises a table (12) which comprises at least one table leg (12A). The illuminated ping pong game (10) further comprises a net (14) securely fastened to a the table (12) along a median thereof The illuminated ping pong game (10) further comprises at least two player's paddles (16) utilized by at least one first player (18A) and second player (18B). At least one player's paddle (16) comprises a first player's paddle (16A) which comprises a first player's paddle handle (16AA) having a first player's paddle handle ON/OFF cap (16AAA) positioned at a bottom distal end of a first player's paddle handle cylinder (16AAB) forming a first player's paddle handle cavity (16AAC) therein. The first player's paddle handle (16AA) further comprises a first player's paddle handle illuminator (16AC) integrally associated therewith. The first player's paddle handle illuminator (16AC) comprises a first player's paddle handle illuminator light (16ACA) positioned at a top distal end within the first player's paddle handle cavity (16AAC). The first player's paddle handle illuminator further comprises a first player's paddle handle power means (16ACB) electrically connected to the first player's paddle handle illuminator light (16ACA) and the first player's paddle handle ON/OFF cap (16AAA). When an user rotates the first player's paddle handle ON/OFF cap (16AAA), the first player's paddle handle illuminator light (16ACA) is activated by the first player's paddle handle power means (16ACB) illuminating a first player's paddle head (16AB) which is securely attached to the first player's paddle handle (16AA).

The illuminated ping pong game (10) preferably may further comprise a second player's paddle comparably constructed as described above.

In a second embodiment, an illuminated ping pong game (10) comprises a table (12) which comprises at least one table leg (12A). The illuminated ping pong game (10) further comprises a net (14) securely fastened to a the table (12) along a median thereof, the net (14) comprises a left net holder (14L) and a right net holder (14R) having a net screening (14A) tightly strung therebetween. The left net holder (14L) comprises a left net holder ON/OFF cap (14LA) positioned at a bottom distal end of a left net holder cylinder (14LB) forming a left net holder cavity (14LC) therein. A left net holder illuminator (14LD) is positioned with the left net holder (14L). The left net holder illuminator (14LD) comprises a left net holder illuminator light (14LDA) positioned at a top distal end of the left net holder cylinder (14LB). A left net holder illuminator power means (14LDB) is electrically connected to the left net holder illuminator light (14LDA) and the left net holder ON/OFF cap (14LA). When an user turns the left net holder ON/OFF cap (14LA), the left net holder illuminator light (14LDA) is illuminated by the left net holder illuminator power means (14LDB). The illumination reflects off a left net holder illuminator mirror (14LDC) emanating light through and from a net middle member (14M) which is integrally connected to the left net holder (14L).

The illuminated ping pong game (10) further comprises at least two player's paddles (16) utilized by at least one first player (18A) and second player (18B). At least one player's paddle (16) comprises a first player's paddle (16A) which comprises a first player's paddle handle (16AA) securely connected to a first player's paddle head (16AB). The at least one player's paddle (16) comprises a second player's paddle (16B) which comprises a second player's paddle handle (16BA) securely connected to a second player's paddle head (16BB).

The illuminated ping pong game (10) may optionally further comprise a second player's paddle (16B) which comprises a second player's paddle handle (16BA) having a second player's paddle handle ON/OFF cap (not shown) positioned at a bottom distal end of a second player's paddle handle cylinder (not shown) forming a second player's paddle handle cavity (not shown) therein. The second player's paddle handle (16BA) further comprises a second player's paddle handle illuminator (not shown) integrally associated therewith, the second player's paddle handle illuminator (not shown) comprises a second player's paddle handle illuminator light (not shown) positioned at a top distal end within the second player's paddle handle cavity (not shown). The second player's paddle handle illuminator (not shown) further comprises a second player's paddle handle power means (not shown) electrically connected to the second player's paddle handle illuminator light (not shown) and the second player's paddle handle ON/OFF cap (not shown). When an user rotates the second player's paddle handle ON/OFF cap (not shown), the second player's paddle handle illuminator light (not shown) is activated by the second player's paddle handle power means (not shown) illuminating a second player's paddle head (16BB) which is securely attached to the second player's paddle handle (16BA). The at least two player's paddles (16) are utilized by at least one first player (18A) and second player (18B).

Optionally, At least one player's paddle (16) comprises a first player's paddle (16A) which comprises a first player's paddle handle (16AA) having a first player's paddle handle ON/OFF cap (16AAA) positioned at a bottom distal end of a first player's paddle handle cylinder (16AAB) forming a first player's paddle handle cavity (16AAC) therein. The first player's paddle handle (16AA) further comprises a first player's paddle handle illuminator integrally associated therewith. The first player's paddle handle illuminator comprises a first player's paddle handle illuminator light (16ACA) positioned at a top distal end within the first player's paddle handle cavity (16AAC). The first player's paddle handle illuminator further comprises a first player's paddle handle power means (16ACB) electrically connected to the first player's paddle handle illuminator light (16ACA) and the first player's paddle handle ON/OFF cap (16AAA), when an user rotates the first player's paddle handle ON/OFF cap (16AAA), the first player's paddle handle illuminator light (16ACA) is activated by the first player's paddle handle power means (16ACB) illuminating a first player's paddle head (16AB) which is securely attached to the first player's paddle handle (16AA). The player's paddle head (16AB, 16BB) is constructed from a light conductive material. The light conductive material is transparent or translucent, such as made of plastic.

The right net holder (14R) comprises a right net holder ON/OFF cap (14RA) positioned at a bottom distal end of a right net holder cylinder (14RB) forming a right net holder cavity (14RC) therein. A right net holder illuminator (14RD) is positioned with the right net holder (14R). The right net holder illuminator (14RD) comprises a right net holder illuminator light (14RDA) positioned at a top distal end of the right net holder cylinder (14RB). A right net holder illuminator power means (14RDB) is electrically connected to the right net holder illuminator light (14RDA) and the right net holder ON/OFF cap (14RA). When an user turns the right net holder ON/OFF cap (14RA), the right net holder illuminator light (14RDA) is illuminated by the right net holder illuminator power means (14RDB). The illumination reflects off a right net holder illuminator mirror (14RDC) emanating light through and from a net middle member (14M) which is integrally connected to the right net holder (14R). The net middle member (14M) is manufactured from a material selected from a group consisting of plastic, plastic composite, rubber, rubber composite, glass, fiberglass, epoxy and carbon-graphite.

Lastly, referring to FIG. 3 which is a front view of a net (14) along line 4—4 of FIG. 1. The net (14) comprises a left net holder (14L) and a right net holder (14R) having a net screening (14A) tightly strung therebetween. The left net holder (14L) comprises a left net holder ON/OFF cap (14LA) positioned at a bottom distal end of a left net holder cylinder (14LB) forming a left net holder cavity (14LC) therein. A left net holder illuminator (14LD) is positioned with the left net holder (14L). The left net holder illuminator (14LD) comprises a left net holder illuminator light (14LDA) positioned at a top distal end of the left net holder cylinder (14LB). A left net holder illuminator power means (14LDB) is electrically connected to the left net holder illuminator light (14LDA) and the left net holder ON/OFF cap (14LA). When an user turns the left net holder ON/OFF cap (14LA). The left net holder illuminator light (14LDA) is illuminated by the left net holder illuminator power means (14LDB). The illumination reflects off a left net holder illuminator mirror (14LDC) emanating light through and from a net middle member (14M) which is integrally connected to the left net holder (14L). The net middle member (14M) is manufactured from a material selected from a group consisting of plastic, plastic composite, rubber, rubber composite, glass, fiberglass, epoxy and carbon-graphite.

The table (12) further comprises a table illuminator (20) positioned under a table illuminator transparent cover (20C). The table illuminator (20) comprises a table illuminator light (20A) electrically connected to table illuminator power means (20B).

The right net holder (14R) comprises a right net holder ON/OFF cap (14RA) positioned at a bottom distal end of a right net holder cylinder (14RB) forming a right net holder cavity (14RC) therein. A right net holder illuminator (14RD) is positioned with the right net holder (14R). The right net holder illuminator (14RD) comprises a right net holder illuminator light (14RDA) positioned at a top distal end of the right net holder cylinder (14RB). A right net holder illuminator power means (14RDB) is electrically connected to the right net holder illuminator light (14RDA) and the right net holder ON/OFF cap (14RA). When an user turns the right net holder ON/OFF cap (14RA), the right net holder illuminator light (14RDA) is illuminated by the right net holder illuminator power means (14RDB). The illumination reflects off a right net holder illuminator mirror (14RDC) emanating light through and from a net middle member (14M) which is integrally connected to the right net holder (14R).

It will be understood that each of the elements described above, or two or more together, may also find an useful application in other types of constructions differing from the type described above.

While the invention has been illustrated and described as embodied in an Illuminated Ping Pong, it is not intended to be limited to the details shown, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by letters patent is set forth in the appended claims:

What is claimed is:

1. An illuminated ping pong game comprising:

A) a table which comprises at least one table leg;

B) a net securely fastened to a the table along a median thereof; and

C) at least two player's paddles utilized by at least one first player and second player, at least one player's paddle comprises a first player's paddle which comprises a first player's paddle handle having a first player's paddle handle ON/OFF cap positioned at a bottom distal end of a first player's paddle handle cylinder forming a first player's paddle handle cavity therein, the first player's paddle handle further comprises a first player's paddle handle illuminator integrally associated therewith, the first player's paddle handle illuminator comprises a first player's paddle handle illuminator light positioned at a top distal end within the first player's paddle handle cavity, the first player's paddle handle illuminator. further comprises a first player's paddle handle power means electrically connected to the first player's paddle handle illuminator light and the first player's paddle handle ON/OFF cap, when an user rotates the first player's paddle handle ON/OFF cap, the first player's paddle handle illuminator light is activated by the first player's paddle handle power means illuminating a first player's paddle head which is securely attached to the first player's paddle handle.

2. The illuminated ping pong game as described in claim 1 further comprises a second player's paddle which comprises a second player's paddle handle having a second player's paddle handle ON/OFF cap positioned at a bottom distal end of a second player's paddle handle cylinder forming a second player's paddle handle cavity therein, the second player's paddle handle further comprises a second player's paddle handle illuminator integrally associated therewith, the second player's paddle handle illuminator comprises a second player's paddle handle illuminator light positioned at a top distal end within the second player's paddle handle cavity, the second player's paddle handle illuminator further comprises a second player's paddle handle power means electrically connected to the second player's paddle handle illuminator light and the second player's paddle handle ON/OFF cap, when an user rotates the second player's paddle handle ON/OFF cap, the second player's paddle handle illuminator light is activated by the second player's paddle handle power means illuminating a second player's paddle head which is securely attached to the second player's paddle handle.

3. The illuminated ping pong game as described in claim 1, wherein the net comprises a left net holder and a right net holder having a net screening tightly strung therebetween.

4. The illuminated ping pong game as described in claim 3, wherein the left net holder comprises a left net holder ON/OFF cap positioned at a bottom distal end of a left net holder cylinder forming a left net holder cavity therein, a left net holder illuminator is positioned with the left net holder, the left net holder illuminator comprises a left net holder illuminator light positioned at a top distal end of the left net holder cylinder, a left net holder illuminator power means is electrically connected to the left net holder illuminator light and the left net holder ON/OFF cap, when an user turns the left net holder ON/OFF cap, the left net holder illuminator light is illuminated by the left net holder illuminator power means, the illumination reflects off a left net holder illuminator mirror emanating light through and from a net middle member which is integrally connected to the left net holder.

5. The illuminated ping pong game as described in claim 4, wherein the right net holder comprises a right net holder ON/OFF cap positioned at a bottom distal end of a right net holder cylinder forming a right net holder cavity therein, a right net holder illuminator is positioned with the right net holder, the right net holder illuminator comprises a right net holder illuminator light positioned at a top distal end of the right net holder cylinder, a right net holder illuminator power means is electrically connected to the right net holder illuminator light and the right net holder ON/OFF cap, when an user turns the right net holder ON/OFF cap, the right net holder illuminator light is illuminated by the right net holder illuminator power means, the illumination reflects off a right net holder illuminator mirror emanating light through and from a net middle member which is integrally connected to the right net holder.

6. The illuminated ping pong game as described in claim 1, wherein the player's paddle head is constructed from a light conductive material.

7. The illuminated ping pong game as described in claim 6, wherein the light conductive material is transparent or translucent.

8. The illuminated ping pong game as described in claim 8, wherein the light conductive material is selected from a group consisting of plastic, plastic composite, rubber, rubber composite, glass, fiberglass, epoxy and carbon-graphite.

9. The illuminated ping pong game as described in claim 1, wherein the player's paddle handle is manufactured from a material selected from a group consisting of plastic, plastic composite, rubber, rubber composite, wood, metal, metal alloy, fiberglass, epoxy and carbon-graphite.

10. The illuminated ping pong game as described in claim 4, wherein the net middle member is manufactured from a material selected from a group consisting of plastic, plastic composite, rubber, rubber composite, glass, fiberglass, epoxy and carbon-graphite.

11. The illuminated ping pong game as described in claim 1, wherein the table further comprises a table illuminator positioned under a table illuminator transparent cover.

12. The illuminated ping pong game as described in claim 11, wherein the table illuminator comprises a table illuminator light electrically connected to table illuminator power means.

* * * * *